US005162002A

United States Patent [19]

Regnier

[11] Patent Number: 5,162,002

[45] Date of Patent: Nov. 10, 1992

[54] CARD EDGE CONNECTOR ASSEMBLY

[75] Inventor: Kent E. Regnier, Lombard, Ill.

[73] Assignee: Molex Incorporated, Lisle, Ill.

[21] Appl. No.: 866,285

[22] Filed: Apr. 10, 1992

Related U.S. Application Data

[63] Continuation of Ser. No. 740,365, Aug. 5, 1991, abandoned, which is a continuation-in-part of Ser. No. 501,577, Mar. 30, 1990, Pat. No. 5,071,371.

[51] Int. Cl.[5] ..... H01R 23/70

[52] U.S. Cl. ..... 439/637; 439/157; 439/60

[58] Field of Search ..... 439/630-637, 439/59, 62, 65, 861, 856, 857, 60, 152, 153, 157

[56] References Cited

U.S. PATENT DOCUMENTS

| | | | |
|---|---|---|---|
| 3,631,381 | 12/1971 | Pittman | 339/176 MP |
| 4,095,866 | 6/1978 | Merrill | 439/60 |
| 4,298,237 | 11/1981 | Griffith et al. | 439/637 |
| 4,780,095 | 10/1988 | Classon et al. | 439/637 |
| 4,806,103 | 2/1987 | Kniese et al. | 439/637 |
| 4,869,672 | 9/1989 | Andrews, Jr. | 439/60 |
| 4,872,851 | 10/1989 | Babuka | 439/60 |
| 4,891,023 | 1/1990 | Lopata | 439/637 |
| 4,993,972 | 2/1991 | Lin | 439/637 |
| 5,052,936 | 10/1991 | Biechler et al. | 439/60 |

FOREIGN PATENT DOCUMENTS 1013151 12/1965 United Kingdom .

*Primary Examiner*—David L. Pirlot
*Attorney, Agent, or Firm*—Charles S. Cohen

[57] ABSTRACT

A card edge connector assembly includes a printed circuit card having an edge and a plurality of first conductive pads arranged in a pattern on one side of the card near the edge, and a plurality of second conductive pads arranged in a pattern on the opposite side of the card spaced inwardly of the edge and the first conductive pads. An elongated housing is provided with a card receiving slot for receiving the edge of the printed circuit card. A plurality of pairs of contact elements are mounted in the housing along the length of the slot. Each pair of contact elements includes a short contact element having a spring contact portion for engaging one of the first conductive pads, and a long contact element having a spring contact portion for engaging one of the second conductive pads. The contact portions of each pair of contact elements are spatially overlapped each other in a direction transversely of the slot to increase the deflection capabilities of the contact elements.

19 Claims, 4 Drawing Sheets

CARD EDGE CONNECTOR ASSEMBLY

RELATED APPLICATION

This is a continuation of copending application Ser. No. 07/740,365 filed on Aug. 5, 1991, now abandoned, which is a continuation-in-part of application Ser. No. 07/501,577, filed on Mar. 30, 1990 U.S. Pat. No. 5,071,371.

FIELD OF THE INVENTION

This invention generally relates to the art of electrical connectors and, particularly, to an improved configuration of contact elements for an electrical connector assembly for receiving the edge of a printed circuit card having conductive pads along the edge thereof.

BACKGROUND OF THE INVENTION

Electrical connector assemblies for making large numbers of interconnections are used extensively in the electrical connector industry, such as for use in computers and other electronic devices. With the ever-increasing miniaturization of the electronics in such devices and the ever-increasing density of the related connector assemblies, continuing problems occur in designing connectors for such use. This is particularly true with connectors commonly known as card edge connectors which are constructed to receive printed circuit cards having conductive pads on one or both sides of the card along the edge of the card which is inserted into the connector assembly.

One of the problems with card edge connector assemblies of the character described above is achieving a desired range of contact engaging forces between the contact elements of the connector assembly and the conductive pads on the printed circuit card. In most such connector assemblies, contact elements are arranged along opposite sides of the card receiving slot of a housing for the connector assembly. The contact elements engage conductive pads on opposite sides of the printed circuit board. Heretofore, a common thickness for a printed circuit card for use with card edge connector assemblies has been on the order of 0.062 inch. With the ever-increasing miniaturization of electronic systems utilizing these connector assemblies, it is desireable to reduce the thickness of such printed circuit cards. This, however creates problems in maintaining the desired range of forces between the contact elements and the conductive pads on the printed circuit card.

More particularly, it is known that the force generated by a spring is equal to the spring constant multiplied by the deflection of the spring (i.e., $f=k \cdot d$). Using this formula, a desired normal force between the contact elements and the card conductive pads can be achieved with a spring contact having a long travel (i.e., deflection) or with a spring contact having a short travel (i.e., deflection). In the connector art, it is generally desirable to use contact elementswith a long travel (i.e., deflection) to achieve the desired range of forces because such a long travel will minimize the affect of any variations due to manufacturing tolerances. That is, for a given variation in travel due to tolerances, the percentage of variation will be smaller with a contact element that is deflected a greater distance. This commonly is termed a low spring rate system. Lower spring rates, in the context of electrical contact elements, normally are accomplished by providing long spring contacts. Of course, there are limitations placed on the contact structure by the miniaturization of the overall) connector assembly.

Heretofore, most attempts to provide a lower spring rate system in card edge connector assemblies of the character describedin order to achieve a desired range of contact forces have utilized preloaded contact elements. However, preloading the contact elements causes problems and/or creates limitations in fabricating and usage of the connector assemblies.

When a large number of contact elements are placed under a preload, stresses are placed on the housing itself which conventionally is fabricated of molded plastic material or the like. These preloading stresses place limitations on the types of plastic material that can be used in certain applications. For instance, it often is desirable to surface mount such connector assemblies on a printed circuit board. During such surface mounting procedures, the housing and contact elements are exposed to elevated temperatures of 220 degrees Centigrade. When certain plastics reach that temperature, and the plastic material is subjected to the forces of the preloaded contact elements, the plastic material has a tendency to creep. Consequently, preloading of contact elements in card edge connector assemblies has definite limitations.

This invention is directed to solving these problems by providing a card edge connector assembly in which the contact elements have a relatively low spring rate but are not preloaded.

SUMMARY OF THE INVENTION

An object, therefore, of the invention is to provide a new and improved card edge connector assembly of the character described.

In the exemplary embodiment of the invention, the connector assembly includes a printed circuit card having an edge and a plurality of first conductive pads arranged in a pattern on one side of the card at least near the edge. A plurality of second conductive pads are arranged in a pattern on the opposite side of the card spaced inwardly of the edge and the first conductive pads. An elongated housing is provided with a card receiving slot for receiving the edge of the printed circuit card. A plurality of first spring contact elements are mounted in the housing along one side of the slot means and having first contact portions for contacting respective ones of the first conductive pads. A plurality of second spring contact elements are mounted in the housing along the opposite side of the slot means and having second contact portions for contacting respective ones of the second conductive pads. The first contact portions of the first contact elements spatially overlap the second contact portions of the second contact elements in a direction transversely of the slot means to increase the deflection capabilities of the contact elements.

Still further, as disclosed herein, one of the first contact elements is disposed in registry with one of the second contact elements on direct opposite sides of the slot means. The printed circuit card includes a plurality of the first and second conductive pads on each side of the printed circuit card, and a plurality of the first and second contact elements are located on each side of the slot means. The first and second contact elements are disposed in an alternating array on each side of the slot.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
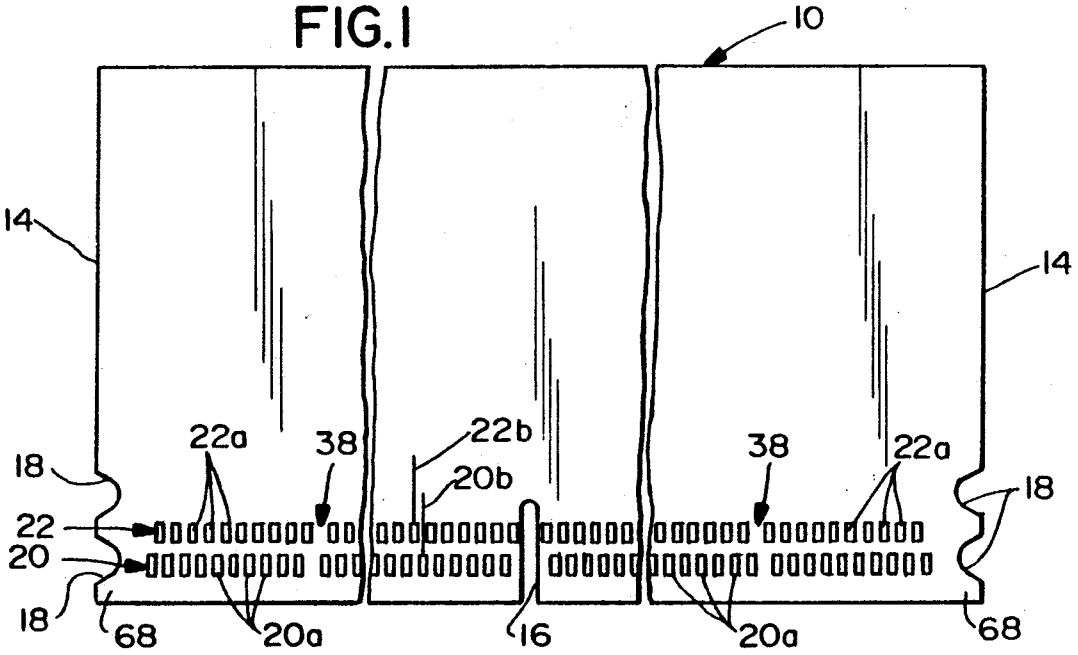
FIG. 1 is a side elevational view of a printed circuit card of the present invention for use with the card edge connector assembly of the invention.

Referring to the drawings in greater detail, and first to FIG. 1, the invention is directed to a card edge connector assembly, described below, for use in conjunction with a printed circuit card, generally designated 10. The card has an elongated insertion edge 12 and opposite side edges 14. For purposes described hereinafter, insertion edge 12 is provided with a locating notch 16, and each side edge 14 is provided with a pair of spaced insertion/eject rounded notches 18.

Generally, printed circuit card 10 has two rows, generally designated 20 and 22, of conductive pads **20*a* and 22*a*, respectively, in linear arrays running generally parallel to insertion edge 12 of the card. Although not shown in the drawings, each conductive pad 20*a* and 22*a* is connected by means of circuit traces 20*b* and 22*b* to appropriate circuitry (not shown) on the card as is known in the art. Only two circuit traces 20*b* and 22*b* are shown in FIG. 1 in order not to clutter the illustration. It can be seen that row 20 of conductive pads 20*a* are located nearer to insertion edge 12 of the card than is row 22 of conductive pads 22*a***.

Figure 2:
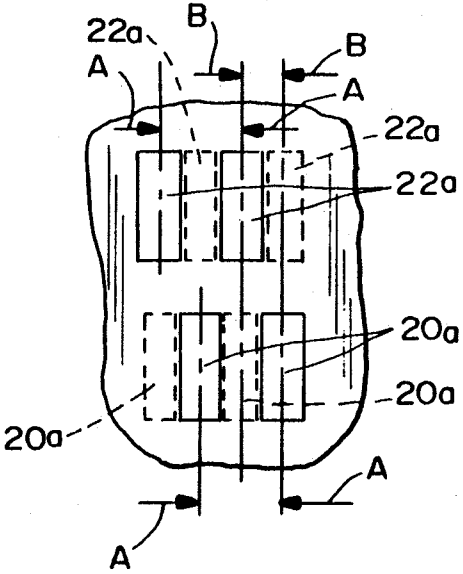
FIG. 2 is a fragmented elevational view, on an enlarged scale, showing two pairs of pads in each row of conductive pads on the printed circuit card of FIG. 1.

Referring to FIG. 2 in conjunction with FIG. 1, a pair of each of the conductive pads **20*a* and 22*a* from the respective rows thereof are isolated to illustrate the high density of printed circuit card 10. In particular, as represented by arrows "A", conductive pads 20*a* in row 20 and conductive pads 22*b* in row 22 have equal spacing which is approximately 0.060 inches. It can be seen that the conductive pads in each row are staggered relative to the pads in the other row. Therefore, the spacing or pitch between alternating conductive pads in the combined rows, as represented by arrows "B", is half of "A" or approximately 0.030 inches. It should be noted that this array of conductive pads 20*a* and 22*a* in rows 20 and 22, respectively, is repeated on the opposite side of printed circuit card 10** but the rows on one side of the card are offset from the rows on the opposite side.

Figure 3:
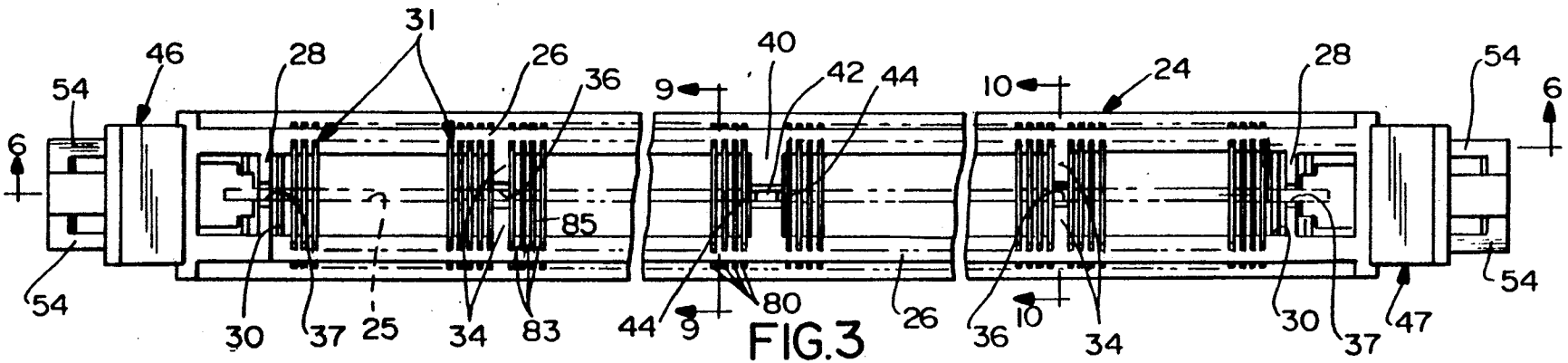
FIG. 3 is a top plan view of the card edge connector assembly of the invention with the contact elements removed.

Referring to FIG. 3, the card edge connector assembly of the invention includes an elongated housing, generally designated 24, which is unitarily molded of a dielectric material. The housing has opposed side walls 26 and opposite endwalls 28 which define an elongated interior cavity 30 therewithin. A plurality of contact elements are mounted in contact receiving cavities 31 in housing 24 with contact portions projecting towards the center of cavity 30, as will be described in relation to FIG. 5 hereinafter. The contacts are spaced or have a pitch that is complementary to the pitch of conductive pads **20*a* and 22*a* as described in relation to FIG. 2. This high density, i.e., small pitch, between the contact elements prevents the molding of partition walls between the contact elements that extend far enough towards the center of housing 24** to define the lateral component of a card receiving slot, as heretofore has been done.

The lateral component of the card receiving slot 25 of housing 24 is provided, in part, by two pairs of opposing partition portions 34 which define openings between inner edges 36 of the partition portions. Each pair of end walls 28 also similarly have opposed inner edges that define an opening 37 therebetween. The openings defined by inner edges 36 and 37 are in alignment longitudinally of the housing to define a portion of the lateral component of the card receiving slot 25. Referring back to FIG. 1, gaps, generally designated 38, are provided in each row 20 and 22 of conductive pads **20*a* and 22*a*, respectively, to accommodate partition portions 34. In essence, one conductive pad is eliminated from each respective row 20 and 22 in order to accommodate each partition portions 34**.

The invention contemplates the provision of complementary interengaging card locating means between printed circuit card 10 and housing 24 intermediate the ends of the housing for locating the card longitudinally of the housing. Because of the high density circuitry involved in the card edge connector assembly of the invention, preferably the card locating means is the sole locating means, exclusive of the latch means described hereinafter, for properly locating the card longitudinally of the housing.

Figure 6:
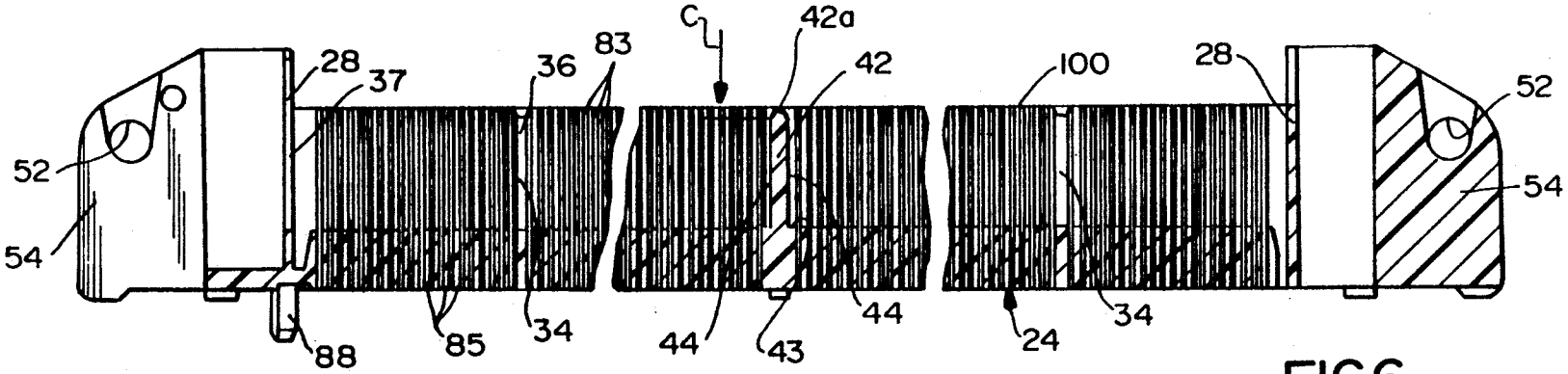
FIG. 6 is a vertical section taken generally along line 6—6 of FIG. 3, with the contact elements and latching and ejecting lever means removed to facilitate the illustration of the connector housing.

More particularly, referring to FIG. 6 in conjunction with FIG. 2, a center partition 40 spans cavity 30 and is integrally molded with and between side walls 26 of the housing. This partition serves multiple functions in laterally supporting side walls 28, in longitudinally and laterally locating the printed circuit card and in polarizing the printed circuit card relative to the housing.

Center partition 40 includes a center narrow portion 42 which has a width (in a direction longitudinally of the housing) to be embraced by notch 16 (FIG. 1) of printed circuit card 10 when the card is inserted into the housing. As seen in FIG. 6, the top **42*a* of partition portion 42 has a tapered lead-in to facilitate guiding notch 16 over the partition in the insertion direction as indicated by arrow "C". Although difficult to see in the Figures, narrow portion 42 is also tapered along its length so that its widest point is at 43 in order to accurately position card 10 longitudinally to define the longitudinal position of card receiving slot 25**.

Partition 40, preferably is offset to one side of a mid-point between opposite ends 28 of housing 24, and notch 16 in printed circuit card 10 correspondingly is offset from a mid-point thereof, to provide polarization means for the card relative to the housing.

In addition to the functions of longitudinally locating the printed circuit card, supporting side walls 26 of the housing and polarizing the circuit card relative to the housing, partition 40 also combines with partition portions 34 and end walls 28 to define the lateral boundary of card receiving slot 25. In particular, it can be seen that with the major body portions of partition 40 being wider than the narrower portion 42 which is embraced by notch 16 of the card, shoulders 44 generally parallel to side walls 26 are provided for engaging the sides of the printed circuit card. These shoulders 44 are in alignment with the inner edges 36 of partition portions 34 and inner edges 37 of end walls 28 to combine therewith to define the lateral position of the card receiving slot 25 of the housing.

Figure 4:
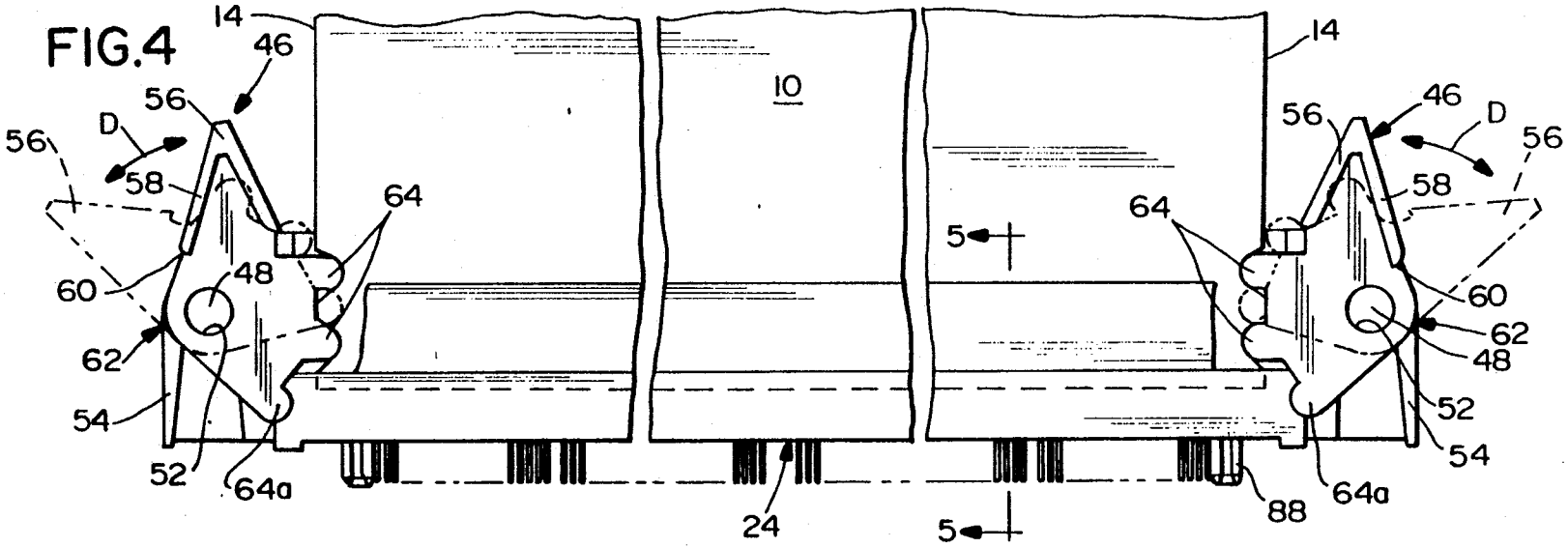
FIG. 4 is a side elevational view of the connector assembly, with the ends thereof cut away to illustrate the latching and ejecting lever means.

Referring to FIG. 4 in conjunction with FIG. 3, the invention contemplates the provision of insertion and ejecting latch arms at the opposite ends of housing 24 for assisting in inserting printed circuit card 10 into the card receiving slot means of the connector assembly and ejecting the card therefrom.

More particularly, a latching and ejecting lever arm, generally designated 46, is provided at each opposite end of housing 24. Each lever arm is pivotally mounted to the housing about a shaft 48 dimensioned to rotate within hole 52 in laterally spaced wing portions 54 of housing 24. It is contemplated that the shaft 48 could either be a dowel pin inserted into arm 46 or an integrally molded portion of arm 46.

Each lever arm 46 is pivotally movable between a latching or insertion position shown in full lines in FIG. 4, and an eject position shown in phantom lines in FIG. 4, as indicated by double-headed arrow "D". Each lever means 46 has a projecting actuating portion 56 for engagement by an operator's thumb or finger. The actuating portion has laterally outwardly projecting flanges 58 terminating in distal ends 60 for engaging wing portions 54 of the housing to define stop means, as at 62, which defines the ejecting position of the lever means and also defines the loading position of the printed circuit card.

In order to interengage each lever means 46 with opposite edges 14 of printed circuit card 10, each lever means is provided with at least a pair of rounded projections 64 which nest for interengagement within rounded recesses 18 (FIG. 1) in side edges 14 of the printed circuit card. In operation, the projections move seriatim into and out of the recesses in response to pivoting of the lever means to thereby insert the card into the slot means of housing 24 in response to pivoting of the lever means toward the latching position shown in full lines in FIG. 4, and to eject the card from the slot means in response to pivoting the lever means toward the eject position as shown in phantom in FIG. 4. The interengagement of the plural projections 64 of the lever means in the plural recesses 18 in the printed circuit card provides a sort of rack-and-pinion arrangement to permit the insertion/ejection of the printed circuit card without the user contacting the card and possibly bending or otherwise damaging it.

Still further, each lever arm 46 is provided with a third projection **64*a* which, when the lever means is in its eject or loading position, provides a locating means for corners 68 (FIG. 1) of the printed circuit card to seat the card when an operator initially positions the card before actuating or pivoting the lever arm to insert the card into the slot 25 of the housing. This enables the operator to easily position the card and then move actuating portions 56** of the lever arm inwardly toward the card simultaneously to insert the card fully into the connector assembly.

Figure 5:
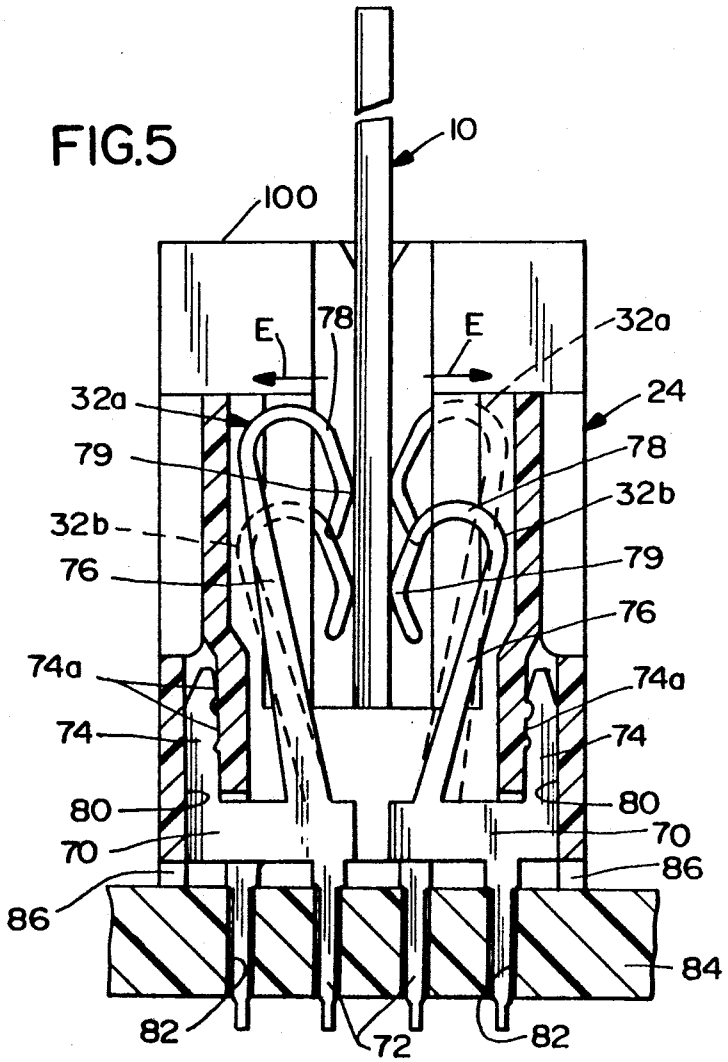
FIG. 5 is a vertical section taken generally along line 5—5 of FIG. 4.
Figure 8:
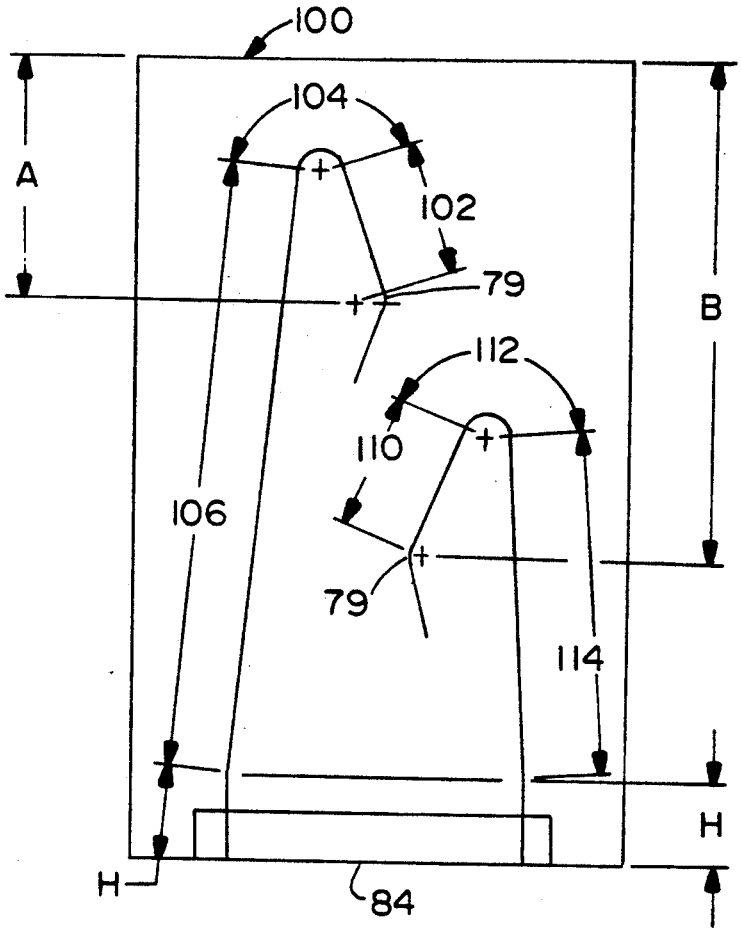
FIG. 8 is a schematic view of the contact elements illustrating the path lengths of the contact elements.
Figure 9:
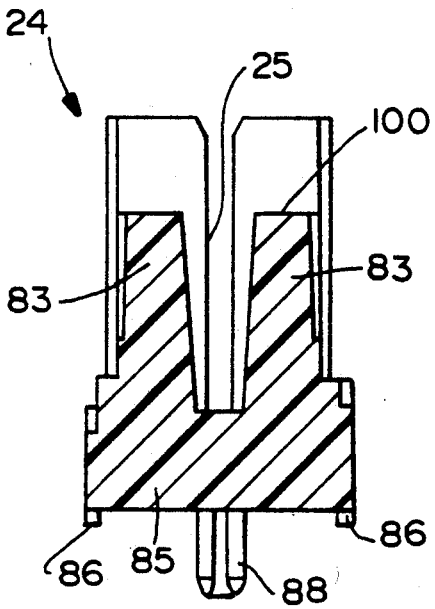
FIG. 9 is a vertical section taken generally along line 9—9 of FIG. 3 with the latch arm removed for clarity.
Figure 10:
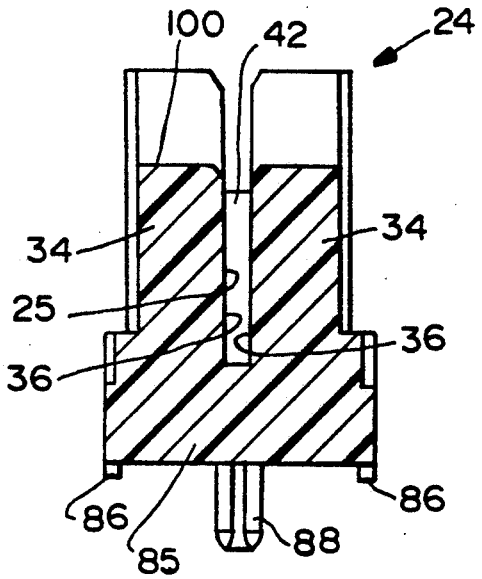
FIG. 10 is a vertical section taken generally along line 10—10 of FIG. 3 with the latch arm removed for clarity.

Referring to FIG. 5, the contact elements of the present invention are shown in detail. Specifically, the contact elements include what, for simplicity purposes, will be termed long contact elements, generally designated **32*a*, and short contact elements, generally designated 32*b*. Such contacts are stamped from a sheet of metal, preferably in pairs of opposed long and short contact element which are retained on a carrier strip (not shown) until insertion into housing 24**. The contact elements are similar to those disclosed in co-pending application Ser. No. 501,577, filed on Mar. 30, 1990, which is incorporated herein by reference.

Each contact element includes a base 70, a solder tail 72 projecting downwardly from the base, a locking arm 74 projecting upwardly from the base, a beam section 76 projecting angularly upward from the base, and a generally inverted U-shaped contact portion 78 formed at the upper end of beam section 76. Base 70 of each contact is rigidly mounted within housing 24 by means of locking arm 74 pressed into passages 80 in the housing. Locking arms 74 have barbs **74*a* for digging into the plastic material of the housing within the passages 80. Solder tails 72 are provided for insertion into holes 82 in a printed circuit board 84 for soldering to circuit traces on the board and/or within the holes. To that end, housing 24 has standoffs 86 for spacing the housing from the printed circuit board, and the housing has conventional board lock pegs 88 (FIG. 4**) for locking the housing to the printed circuit board at least prior to soldering procedures.

Although similarly shaped, the beam section 76 of long contact element **32*a* is different from that of short contact element 32*b*. In particular, the long contact element 32*a* and short contact element 32*b* are configured so that each exerts an equal normal force on its respective contact pad 22*a* and 20*a* at contact point 79 of contact portion 78 when the long and short contact elements are displaced an equal amount. In order to achieve this result, since the contact point 79 of long contact element 32*a* is further from its base 70 than contact point 79 of short contact element 32*b* is from its base 70, the combination of beam section 76 and contact portion 78 of long contact element 32*a* must have a spring rate equal to that of the combination of beam section 76 and contact portion 78 of short contact element 32*b*. Since the contact portions 78 of both contact elements are identically shaped, beam section 76 of long contact element 32*a* is shown as being wider (transverse to the housing 24 as shown in FIG. 5) than the beam section of short contact element 32*b*** at equal distances along their respective beams from their respective bases. Of course, other configurations could be utilized to achieve such equal normal forces including stamping the long and short contact elements from different thickness materials.

Contact portions 78 at the end of beam sections 76 of long and short contact elements 32a and 32b, respectively, are mounted within housing 24 of the connector assembly in opposing pairs spaced longitudinally of the housing such that contact portion 78 of one long contact element 32a engages one of the conductive pads 22a in one of the rows 22 thereof on the respective side of printed circuit card 10. Contact portion 78 of the opposed short contact element 32b engages the conductive pad 20a in the row 20 thereof on the opposite side of printed circuit card 10. On each side of the housing 24, the long and short contact elements alternate. As a result, the end of one side wall begins with a short contact element and the other side wall begins with a long contact element. With an understanding that contact elements 32a and 32b are mounted within housing 24 in pairs thereof projecting perpendicular to side walls 26 of the housing as shown in FIG. 5, the arrays of conductive pads 20a and 22a on opposite sides of printed circuit card 20 must be correspondingly arranged. In other words, "looking through" printed circuit card 10 in FIGS. 1 and 2, one conductive pad 20a on one side of the printed circuit card will be positioned beneath one conductive pad 22a on the opposite side of the printed circuit card. This is why the printed circuit card must be polarized within the connector assembly.

Figure 7:
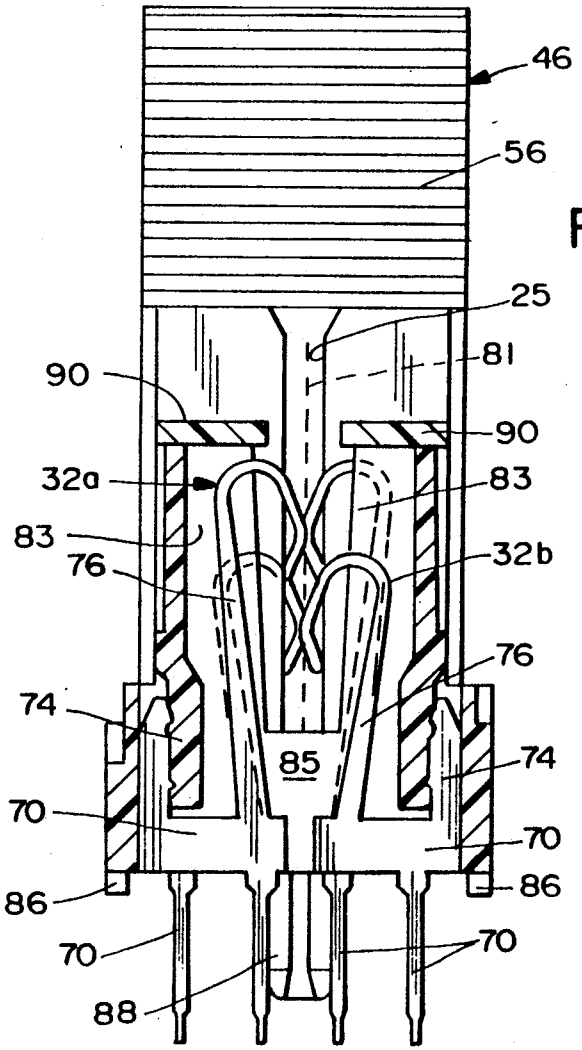
FIG. 7 is a vertical section similar to that of FIG. 5, with the printed circuit card removed to show the contact elements in their unbiased condition.

As shown in FIG. 7, which depicts the contact elements in an undeflected state, contact point 79 of each contact element extends slightly across the lateral centerline 81 of the card receiving slot 25. However, because the contact elements are arranged in opposed pairs of long and short contact elements 32a and 32b, the opposed contacts do not touch each other. By extending the contact point past the centerline, the contact point of each element is able to travel a greater distance without the beam section 76 contacting side wall 26. That is, if the contact point 79 did not extend to the centerline 81, the contact elements would not be able to deflect as far before the edge of beam section 76 would contact the inner portion of the side wall 26. This configuration permits the use of a contact element having a lower spring rate which is desirable because it minimizes the affect of manufacturing variations on the forces exerted between the contact elements and their respective pads. As a result, less wear is likely to occur between the contact elements and the pads. Further, if desired, the contact element configuration permits the use of thinner printed circuit cards as compared to those known in the prior art.

Because of the configuration of the contact element, including the fact that they are stamped rather than stamped and formed, they have a greater tendency to bend along the longitudinal axis of the housing. As a result, relatively thin support walls 83 project perpendicularly from each side wall 26 to support the contact elements one each side and prevent them from bending and contacting the adjacent contact elements. Thus, each contact element has a pair of support walls 83 positioned on opposite longitudinal sides thereof. These support walls project inwardly from side walls 26 and upwardly from base support members 85 which span the housing 24 from one side wall 26 to the other. The top of the base support members 85 form the bottom surface of the card receiving slot 25. Due to the close spacing between the contact elements, the support walls 81 must be extremely thin which prevents them from projecting to and defining the edge of card receiving slot 25. Accordingly, as discussed above, partitions 34, end walls 28 and partition 40 act to laterally define the card receiving slot 25.

Finally, as shown in FIG. 7, an optional dust cover 90 can be positioned over a portion of cavity 30 in order to restrict air flow within the cavity. This could be utilized to reduce the build-up of films, oxides and the like on the contact point 79 of the contact elements. Of course, the cover would not impede in any way the insertion and ejection of board 10 to and from the connector housing 24.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A card edge connector assembly for use with a printed circuit card having an edge and a plurality of first conductive pads arranged in a pattern on one side of the card near the edge, and a plurality of second conductive pads arranged in a pattern on the opposite side of the card spaced inwardly of the edge and the first conductive pads, said assembly comprising an elongated housing having a card receiving slot means for receiving said edge of the printed circuit card;

a plurality of first spring contact elements mounted in the housing along one side of the slot means and having first contact portions for contacting respective ones of the first conductive pads when said card is inserted into said connector assembly;

a plurality of second spring contact elements mounted in the housing along the opposite side of the slot means and aligned relative to the longitudinal axis of said housing with said first spring contact elements to create opposed pairs of contact elements, said second spring contact elements having second contact portions for contacting respective ones of the second conductive pads when said card is inserted into said connector assembly;

each said first and second contact elements being stamped from sheet metal stock to create a stamped edge of said contact element which is perpendicular to said sheet metal stock, each said first contact portion and each said second contact portion being a portion of said stamped edge of each respective contact element; and the first contact portions of the first contact elements projecting into said slot means a predetermined amount immediately prior to receiving said printed circuit card to a define a datum plane, and said second contact portions of the second contact elements projecting into said slot means generally towards said first contact elements and extending at least to said datum plane immediately prior to receiving said printed circuit card to increase the deflection capabilities of the contact elements, said first contact portions and said second contact portions being at different elevations.

2. The card edge connector assembly of claim 1 wherein said first and second contact portions slidingly engage said first and second conductive pads as said printed circuit card is moved into its operational position within aid card receiving slot.

3. The card edge connector assembly of claim 1 wherein said contact portions of said contact elements are mounted in the housing for free movement relative thereto.

4. The card edge connector assembly of claim 3 wherein said contact elements each have a base rigidly mounted on the housing, a spring beam section extending from the base and terminating in the contact portion, the beam section being freely movable relative to the housing.

5. The card edge connector assembly of claim 4 wherein said contact portion comprises an inverted U-shaped spring contact portion of the contact element.

6. The card edge connector assembly of claim 1 wherein in said card includes a plurality of said first and second conductive pads on each side of the printed circuit card, and said connector assembly includes a plurality of said first and second contact elements on each side of the slot.

7. The card edge connector assembly of claim 6 wherein said first and second contact elements are disposed in an alternating array of each side of the slot.

8. An electrical connector for providing electrical connection between a plurality of card contacts on a printed circuit card generally adjacent an edge thereof and a plurality of board contacts on a printed circuit board, said printed circuit card being generally planar and having first and second faces, said first and second faces each having upper and lower rows of card contacts generally parallel to said edge, said upper row being positioned further from said edge than said lower row and being displaced from said lower row along said edge, said card contacts of said upper row being electrically isolated from those of said lower row, said connector comprising:

a housing having a mounting base, an elongated cavity for receiving said card contacts, and a plurality of contact element receiving slots spaced along the cavity; and a plurality of first and second resiliently deflectable contact elements stamped from sheet metal stock to create a stamped edge which is perpendicular to said sheet metal stock, each contact element having a base and a beam section, each beam section extending in cantilever fashion away from said base to a contacting portion formed from a portion of the stamped edge, each contacting portion of said first contact elements contacting one of said plurality of lower card contacts and each contacting portion of said second contact elements contacting one of said plurality of upper card contacts, said contacting portions of said first contact elements being at a different elevation relative to said mounting base than said contacting portions of said second contact elements; and said first and second contact elements being positioned in said contact element receiving slots on opposite sides of said elongated cavity as opposed pairs of first and second contact elements, each pair being located along a line perpendicular to the longitudinal axis of said cavity, and said first and second contact elements being sized and configured so that the contacting portion of each said contact element extends along said perpendicular line at least to the longitudinal centerline of said elongated cavity, said contacting portions being movable from an undeflected position to a deflected position by movement of said printed circuit card to a fully operational position.

9. The electrical connector of claim 8 wherein each of said first and second contact elements includes only one beam section.

10. The electrical connector of claim 8 wherein the beam sections of said first and second contact elements are dimensioned so that the contacting portion of said first and second contact elements exert equal normal forces on said card contacts.

11. The electrical connector of claim 8 wherein said first and second contacting portions slidingly engage respective card contacts on said printed circuit card as said printed circuit card is positioned at an operational position within said card receiving slot.

12. The electrical connector of claim 8 wherein said contact elements are longitudinally spaced along said cavity with said first and second contact elements alternating along each side of said cavity, said contact elements being positioned to create alternating pairs of first and second contact elements located on opposite sides of said cavity.

13. The electrical connector of claim 12 wherein each of said first and second contact elements includes only one beam section.

14. The electrical connector of claim 12 wherein the contacting portion of each contact element is located on a generally U-shaped member.

15. An electrical connector for providing electrical connection between a plurality of card contacts located on a first substrate generally adjacent an edge thereof and a plurality of board contacts on a second substrate, said first substrate being generally planar and having first and second faces, said first and second faces each having upper and lower rows of card contacts generally parallel to said edge, said upper row being positioned further from said edge than said lower row and being displaced from said lower row along said edge, said connector comprising:

a housing having an elongated cavity for receiving said card contacts, and a plurality of spaced terminal receiving apertures on opposite sides along the cavity; and a plurality of first and second resiliently deflectable terminals stamped from sheet metal stock to create a stamped edge which is perpendicular to said sheet metal stock, each terminal having a base and a beam section, each beam section extending in cantilever fashion away from aid base to a U-shaped section, a contacting portion of the stamped edge of each U-shaped section making contact with one of said plurality of card contacts, the beam section of each first terminal being longer than the beam section of said second terminal;

said terminals being positioned as opposed paris of first and second terminals, each pair being located along a line perpendicular to the longitudinal axis of said cavity, and wherein the contacting portion of each said terminal extends along said perpendicular line at least to the longitudinal centerline of said elongated cavity.

16. The electrical connector of claim 15 wherein the beam section on said first terminal emerges from its respective base at a first point and the beam section of said second terminal emerges from its respective base at a second point, the cross-sectional dimension of the beam section of said first terminal being greater than the cross-sectional dimension of the second terminal taken at equal distances along the respective beam sections from the first and second points.

17. The electrical connector of claim 15 wherein said contacting portions of said terminals slidingly engage respective ones of said card contacts on aid first substrate as said first substrate is positioned at an operational position within said card contact receiving cavity.

18. The electrical connector of claim 15 wherein the beam sections of said first and second terminals are dimensioned so that the contacting portion of said first and second terminals exert equal normal forces on said card contacts.

19. The electrical connector of claim 18 wherein the beam section of each said first and second terminals taper uniformly from the respective base thereof to the respective U-shaped section.

* * * * *